US005779071A

United States Patent [19]

Brown et al.

[11] Patent Number: 5,779,071

[45] Date of Patent: *Jul. 14, 1998

[54] NURSING BOTTLE WITH AN AIR VENTING STRUCTURE

[75] Inventors: Craig E. Brown, Mt. Zion, Ill.; Robert J. Brown; Bernard J. Kemper, both of Bonne Terre, Mo.; David E. Hays, Desloge, Mo.

[73] Assignee: New Vent Designs, Inc., St. Louis, Mo.

[ * ] Notice: The term of this patent shall not extend beyond the expiration date of Pat. No. 5,570,796.

[21] Appl. No.: 589,117

[22] Filed: Jan. 19, 1996

Related U.S. Application Data

[63] Continuation-in-part of Ser. No. 511,590, Aug. 4, 1995, Pat. No. 5,570,796.

[51] Int. Cl.[6] ..... A61J 9/04

[52] U.S. Cl. ..... 215/11.5; 215/11.1; 215/902; 220/DIG. 27

[58] Field of Search ..... 215/309, 6, 11.1, 215/11.4, 11.5, 902; 220/366.1, 367.1, 745, 748, DIG. 27; 222/188

[56] References Cited

U.S. PATENT DOCUMENTS

| | | | |
|---|---|---|---|
| 189,691 | 4/1877 | Briere | 215/11.5 |
| 345,518 | 7/1886 | Lelievre | 215/11.1 |
| 679,144 | 7/1901 | Hardesty | 222/188 X |
| 834,014 | 10/1906 | Lyke | 215/165 X |
| 1,600,804 | 9/1926 | Donaldson | 215/11.1 |
| 2,156,313 | 5/1939 | Schwab | 222/188 X |
| 2,239,275 | 4/1941 | Schwab | 222/188 X |
| 2,610,755 | 9/1952 | Gits | 215/11.5 |
| 2,742,168 | 4/1956 | Panetti | 215/11.4 |
| 2,744,696 | 5/1956 | Blackstone | 215/11.1 |
| 3,059,797 | 10/1962 | Wilkinson et al. | 215/11.1 |
| 5,570,796 | 11/1996 | Brown et al. | 215/11.5 |

FOREIGN PATENT DOCUMENTS

| | | | |
|---|---|---|---|
| 273185 | 6/1927 | United Kingdom | 215/11.1 |
| 454053 | 9/1936 | United Kingdom | 215/309 |

*Primary Examiner*—Sue A. Weaver

*Attorney, Agent, or Firm*—Herzog, Crebs & McGhee, LLP

[57] ABSTRACT

A container having an open top and being adapted to be filled with liquid, wherein a vacuum is prevented from being formed within the container when inverted comprising a receptacle adapted to contain a quantity of liquid, a vent unit adapted to fit within the receptacle comprising a reservoir tube having an upper and lower portion, the reservoir tube having a proximal first end adjacent the top of the container and an open second end projecting sufficiently downwardly in the container, wherein the vent unit has an airway between the outside of the container and a point in the reservoir tube, a reservoir tube having a distal end having an opening, the vent tube projecting downwardly into the upper portion of the vent tube, and an airway extending from outside the container through the vent tube into the vent unit so that when the container is filled with liquid and inverted, the open end of the reservoir tube is above the liquid level in the container and the opening in the vent tube is above the liquid level in the upper portion of the vent unit forming a continuous air path from outside of the container through the extension and through the lower portion of the reservoir tube.

9 Claims, 6 Drawing Sheets

NURSING BOTTLE WITH AN AIR VENTING STRUCTURE

CROSS REFERENCE TO RELATED APPLICATION

This invention is a continuation-in-part of U.S. application Ser. No. 08/511,590 now U.S. Pat. No. 5,570,796 by Craig E. Brown and Robert J. Brown, the disclosure of which is hereby incorporated by reference.

FIELD OF THE INVENTION

This invention relates to nursing bottles. More particularly, this invention relates to nursing bottles having an air vent to prevent the creation of a vacuum inside the bottle that could make it more difficult for an infant to suck liquid from the bottle.

BACKGROUND OF THE INVENTION

Babies are born with the instinct to suckle milk from their mothers' breasts, but it is often necessary for them to drink liquids from other sources. Babies are unable to drink liquids from glasses or cups without spilling so it is common throughout the world to feed liquids to babies in nursing bottles, also known as baby bottles. A nursing bottle features a rubber nipple with a small hole in its tip secured across an opening in the top of a liquid container. A nursing bottle is used by filling the container with liquid, securing the nipple, inverting the bottle, and placing the nipple into the baby's mouth. The baby then sucks on the nipple to withdraw the liquid.

A conventional nursing bottle is tightly sealed except for the small opening in the nipple. As the baby nurses, the liquid volume inside the bottle decreases and the air volume increases. However, ambient air is unable to enter the bottle so a partial vacuum is created inside the bottle. The partial vacuum, in turn, impedes the flow of liquid out the nipple and forces the baby to suck harder to withdraw the liquid. As the baby sucks harder on the nipple, ambient air inadvertently and inevitably enters the baby's mouth and stomach. Excessive air in the stomach and other parts of the alimentary canal causes colic, a condition characterized by abdominal discomfort and pain. See generally O. P. Mathew, *Science of Bottle Feeding,* The Journal of Pediatrics, October 1991, 511; and W. R. Treem, *Infant Colic,* Pediatric Clinics of North America, October 1994, 1121.

Many attempts have been made to provide a nursing bottle with an air vent to enable ambient air to enter the container during use. For example, Roderick, U.S. Pat. No. 598,231, issued Feb. 1, 1898, discloses a nursing bottle having a U-shaped air tube. One end of the tube communicates with the top of the container interior while the other end communicates with the ambient air outside the bottle. When the bottle is inverted, liquid rises into the tube and impedes the flow of air into the interior of the container. If the bottle is placed upright quickly, the liquid in the tube does not have a chance to drain and it remains in the tube. When the bottle is again inverted, the liquid spills out the end of the tube which communicates with the ambient air. Other nursing bottles with air vents are disclosed in Van Cleave, U.S. Pat. No. 927,013, issued Jul. 6, 1909; Davenport, U.S. Pat. No. 1,441,623, issued Jan. 9, 1923; and Perry, U.S. Pat. No. 2,061,477, issued Nov. 17, 1936. None of these nursing bottles completely solves the problem of venting the interior of the bottle at atmospheric pressure while preventing leaks and spills. Accordingly, a demand still exists for a nursing bottle which prevents the formation of a partial vacuum inside the bottle during nursing and yet resists spills.

SUMMARY OF THE INVENTION

The nursing bottle of the present invention provides a nursing bottle which prevents the formation of a partial vacuum inside the bottle during nursing, yet resists spills. The nursing bottle is easy to clean and prevents the formation of a partial vacuum without requiring gaskets. Moreover, an embodiment of the present invention provides a nursing bottle having a vent unit which is adapted to fit inside the bottle.

Generally, the nursing bottle of the present invention comprises a container adapted to contain a quantity of liquid and having an opening at its top for the reception of a nipple; a vent unit adapted to fit within the container comprising a vent tube having an upper and lower portion, the vent tube having an open end projecting sufficiently downwardly into the container, an airway in the vent unit extending between the outside of the container and a point in the vent tube above the level of liquid trapped in the vent tube when the nursing bottle is inverted, the lower portion of the vent tube having a volume less than that of the upper portion so that, when the container is filled with liquid and inverted, the liquid from the lower portion only partially fills the upper portion, and the airway and vent tube allow atmospheric air to flow into the bottle to prevent the formation of a vacuum inside the bottle when liquid is withdrawn. Accordingly, liquid continues to flow freely through the nipple and the baby nursing from the bottle is much less prone to swallow air and develop colic. The nursing bottle of this invention completely eliminates the possibility of leaks and spills when used properly and it is easy to clean.

BRIEF DESCRIPTION OF THE DRAWINGS

Corresponding reference numerals indicate corresponding parts throughout the drawings.

DETAILED DESCRIPTION OF THE PREFERRED EMBODIMENTS

This invention is best understood by reference to the drawings.

Figure 1:
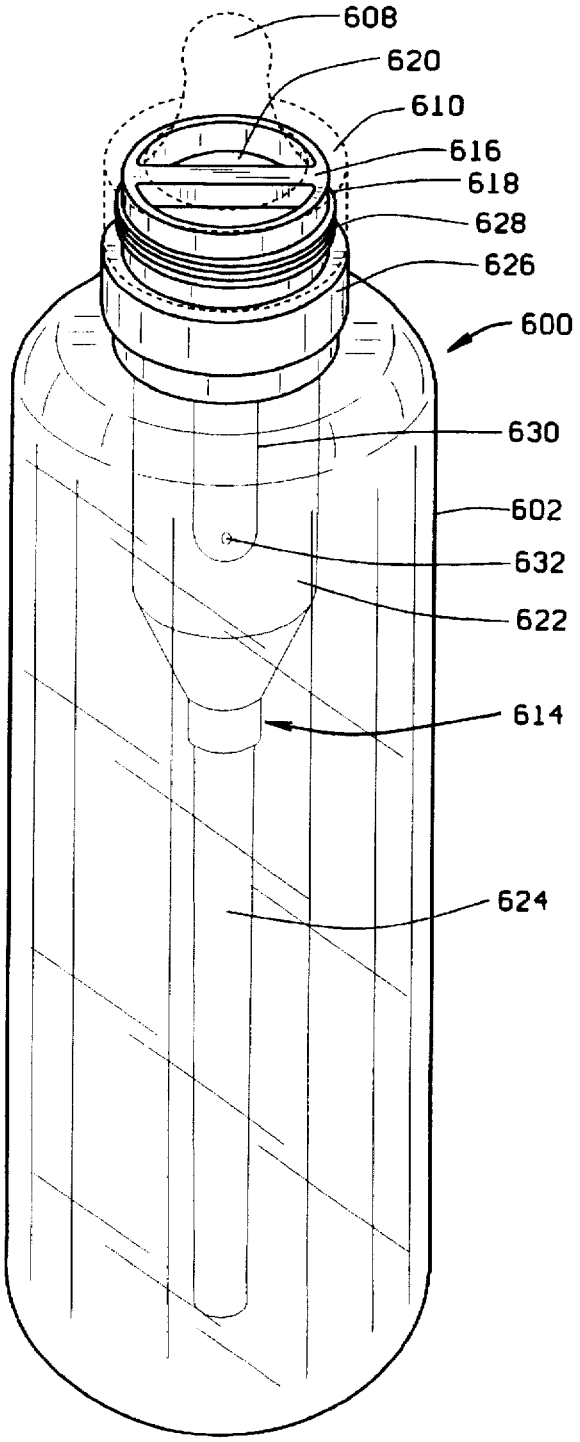
FIG. 1 is a perspective view of a first embodiment of a nursing bottle constructed according to the principles of this invention.
Figure 2:
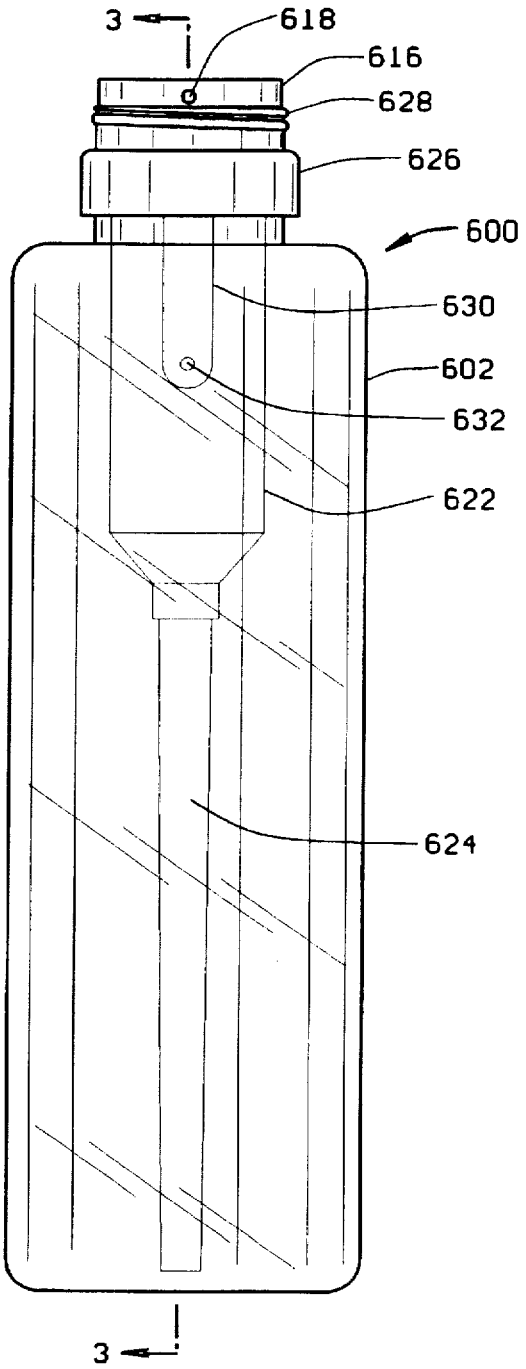
FIG. 2 is a front plan view of the nursing bottle of the first embodiment.
Figure 3:
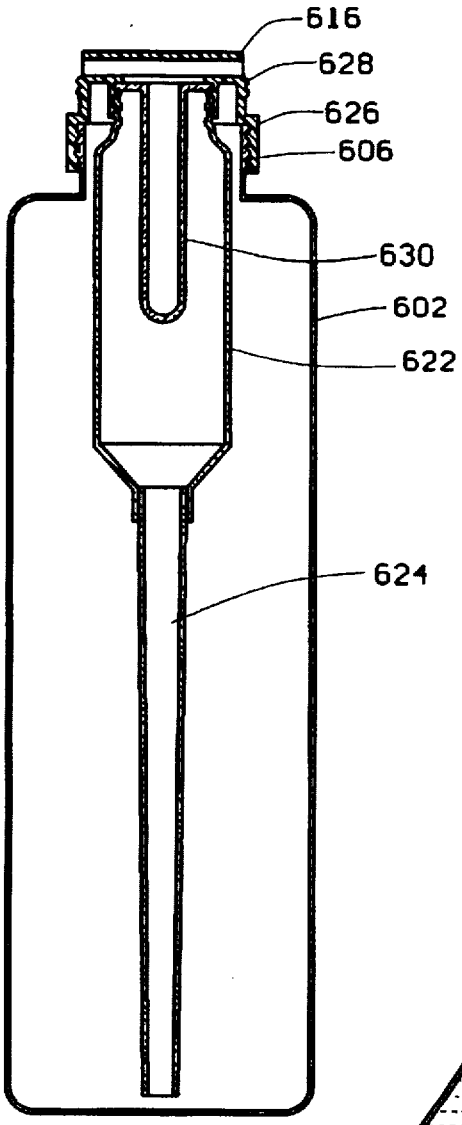
FIG. 3 is a sectional front plan view of the nursing bottle of the first embodiment.
Figure 4:
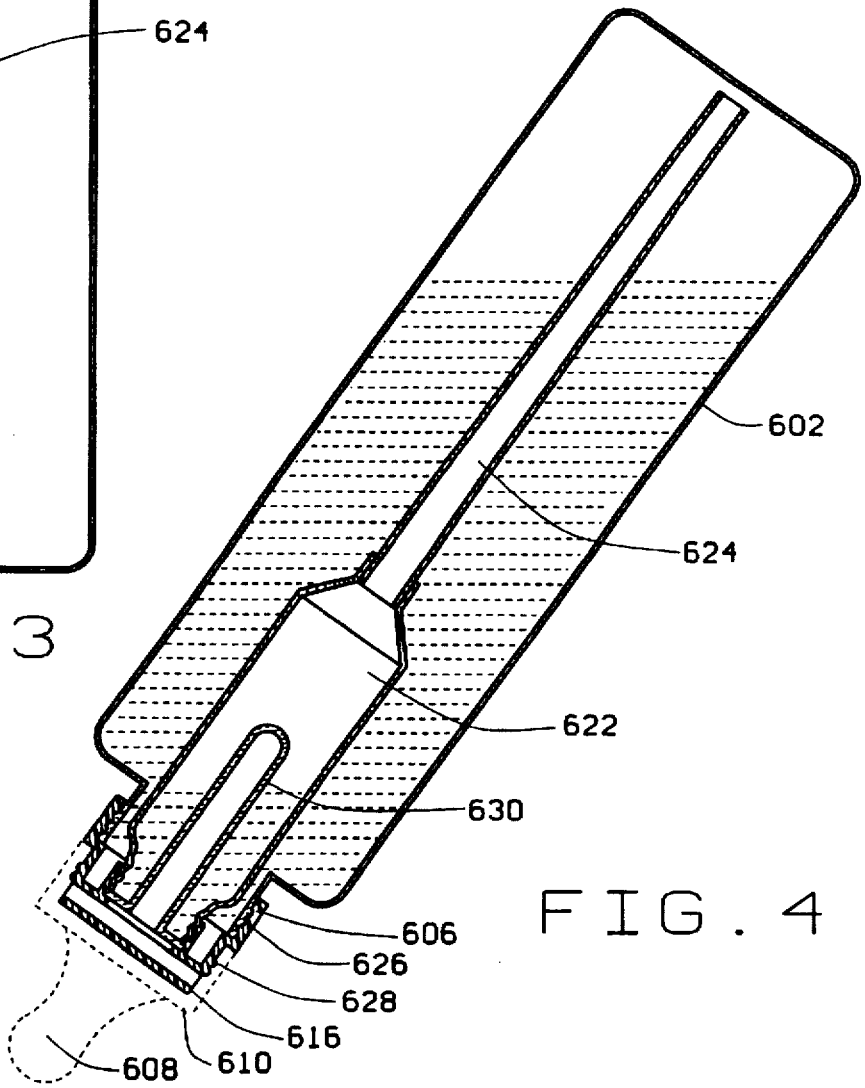
FIG. 4 is a sectional elevational view of the nursing bottle of the first embodiment shown in the inverted, feeding position.
Figure 5:
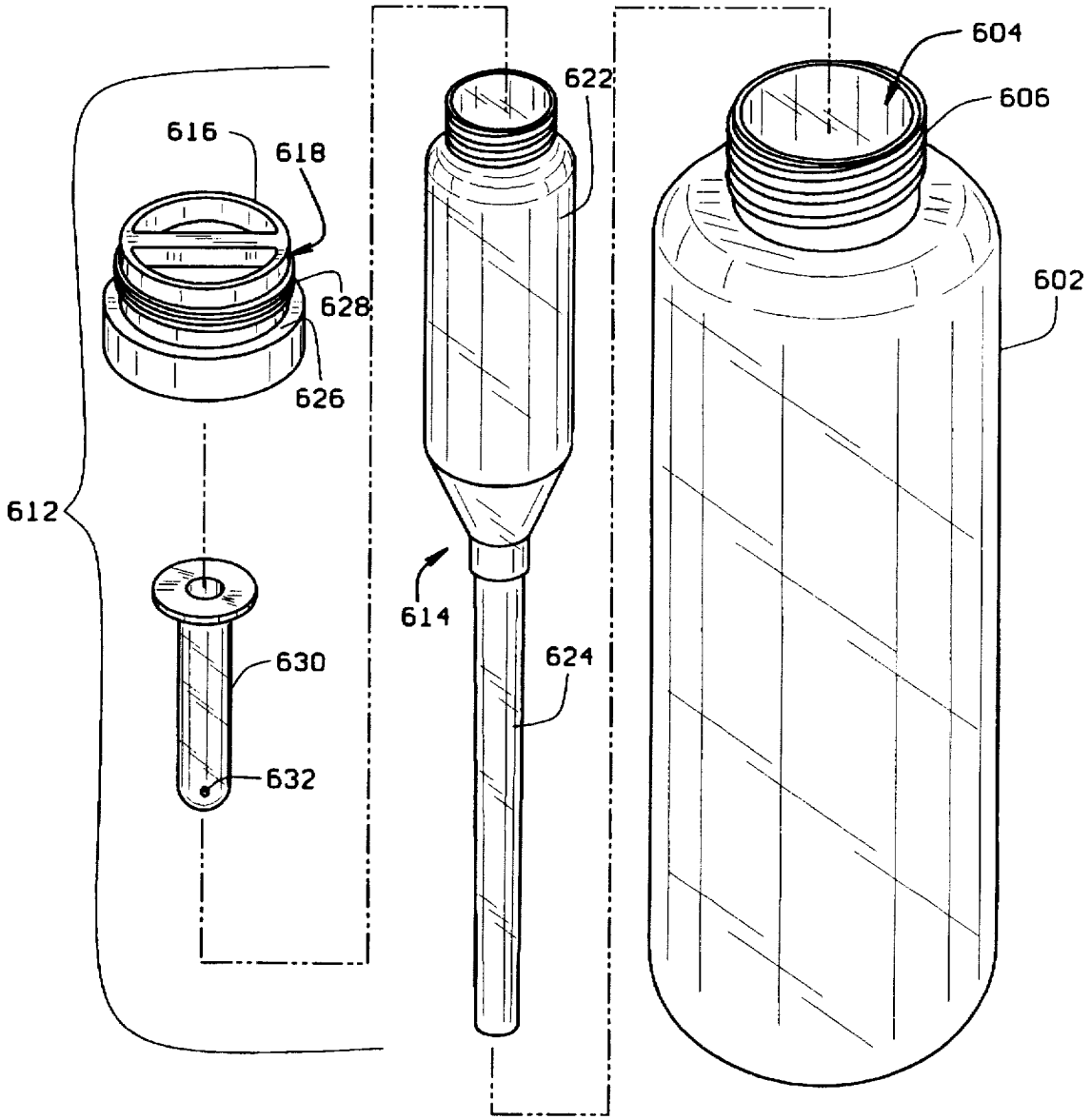
FIG. 5 is a perspective, exploded view of the nursing bottle of the first embodiment.

The first embodiment of this invention is shown in FIGS. 1–5. The bottle 600 of this first embodiment comprises a conventional container 602, having an open top 604, surrounded by a threaded neck 606. The bottle 600 also includes a conventional nipple 608 that can be secured with a threaded ring-shaped collar 610 to the container. However, bottle 600 also comprises a vent unit 612 interposed between the container 602 and the nipple 608 collar 610 assembly.

The vent unit 612 comprises a reservoir tube 614 having a first end adjacent the top of the bottle 600, and an open second end projecting sufficiently downwardly in the container that when the bottle 600 is inverted, the second end is above the liquid level in the inverted container. The vent unit 612 further comprises a vent insert 616 which abuts between the reservoir tube 614 and nipple 608. The vent insert 616 prevents liquid from entering an airway while allowing air to flow from the reservoir tube 614 through the airway. The insert 616 includes curved slots 620 to permit liquid to flow through the insert from the interior of the container 602 to the nipple 608. The vent unit airway 618 extends between the outside of the bottle 600 and a point in the reservoir tube 614 above the level of the liquid trapped inside the vent tube when the bottle 600 is inverted. Thus, the airway 618 and the end of the reservoir tube 614 connect the air space that forms above the liquid when the bottle is inverted with the atmosphere, thereby preventing the formation of a partial vacuum inside the bottle as liquid is drawn through the nipple.

As best shown in the figures, the upper portion 622 of the reservoir tube 614 preferably has a much larger cross-sectional area than the lower portion 624, to more easily accommodate the liquid trapped in the lower portion of the vent tube when the bottle 600 is inverted.

The vent unit 612 has a threaded collar 626 for securing the unit on the threaded neck 606 of the container 602. The top of the unit 612 has external threads 628 on which the conventional collar 610 and nipple 608 can be secured. The passageway extends from an opening in the side of the vent unit 612 to vent tube 630 that projects downwardly into the upper portion 622 of the reservoir tube 614. The vent tube 630 projects sufficiently into the upper portion 622 of the reservoir tube 614 so that the distal end of the vent tube is above the level of the liquid that is trapped in the reservoir tube when the bottle 600 is inverted. There is an opening 632 in the distal end of the vent tube. The opening is fairly small, and is preferably in the side of the vent tube, to help prevent liquid from escaping through the airway 618.

In use, the container 602 is filled with a liquid and the vent unit is inserted into the container, and screwed onto the threaded neck 606 of the container. The ring-shaped collar 610 and nipple 608 are then screwed onto the vent unit 612. As shown in FIG. 15, when the assembled bottle 600 is inverted so that an infant can suck the liquid from the nipple, some of the liquid is trapped in the reservoir tube 614, and this liquid flows to the upper portion 622 of the reservoir tube. Because of the size of the upper portion 622 of the reservoir tube, and the length of the vent tube 630, the upper end of the vent tube, and in particular the opening 632 in the lower end of the vent tube, is above the level of the liquid trapped in the inverted reservoir tube. Thus there is a continuous air path from outside the bottle through the vent tube and through the lower portion of the reservoir tube to the air space in the top of the bottle. This allows atmospheric air to replace the volume of fluid sucked through the nipple, preventing the creation of a partial vacuum that would make it difficult for the infant to draw fluid from bottle.

Figure 6:
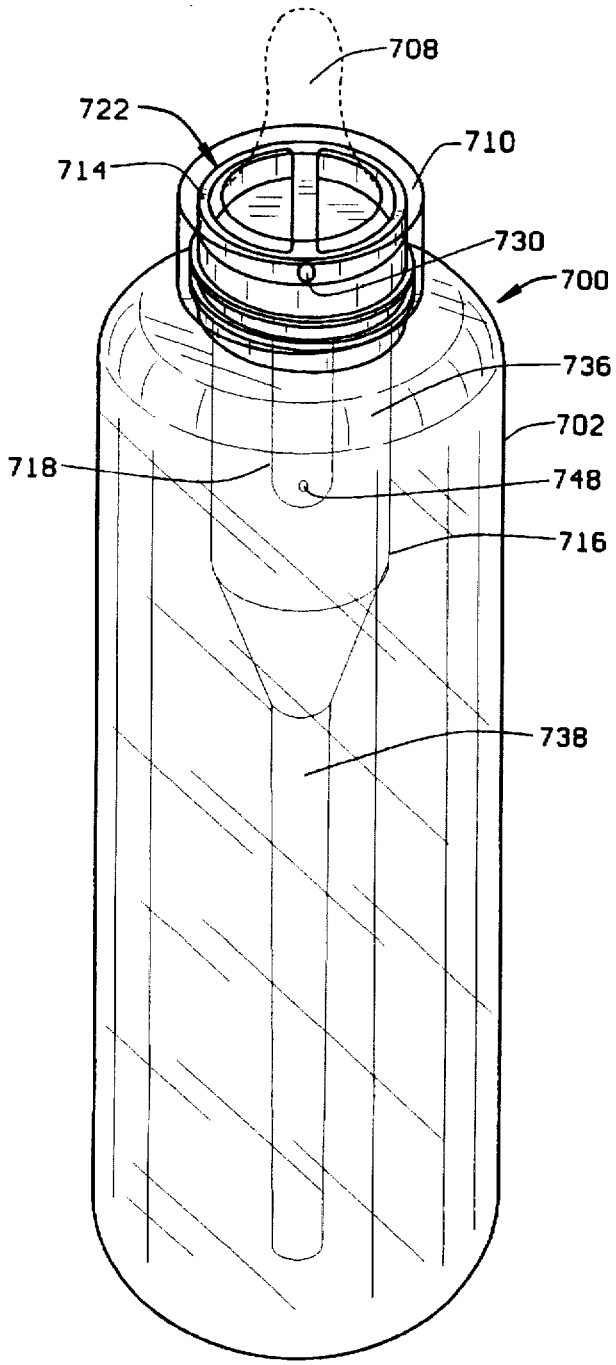
FIG. 6 is a perspective view of a second embodiment of a nursing bottle constructed according to the principles of this invention.
Figure 7:
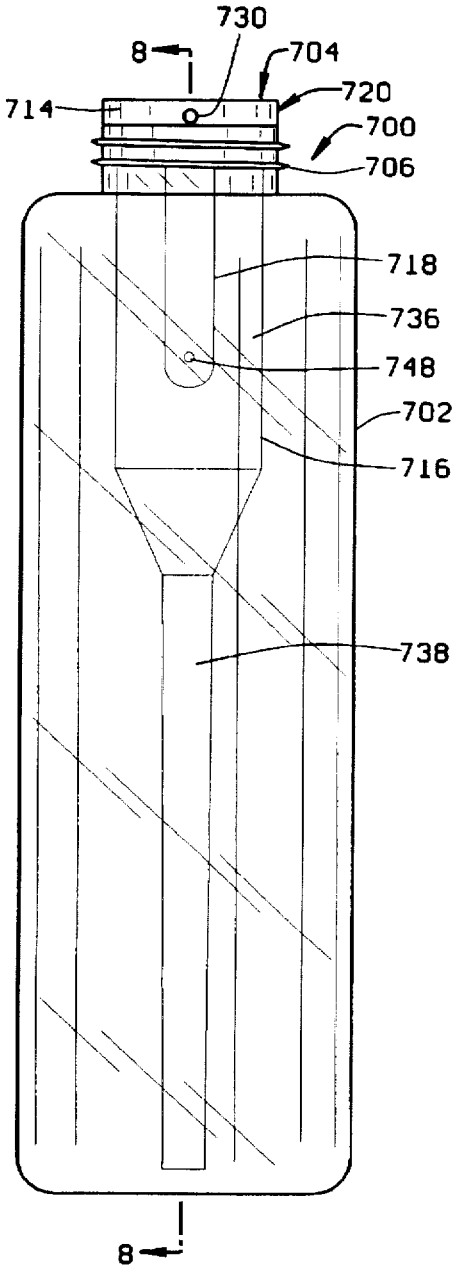
FIG. 7 is a front plan view of the nursing bottle of the second embodiment.
Figure 8:
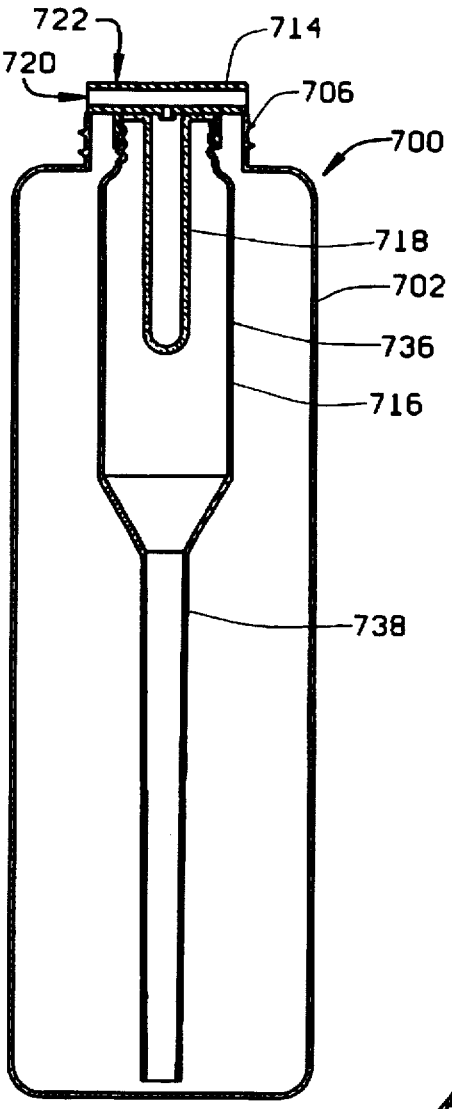
FIG. 8 is a sectional front plan view of the nursing bottle of the second embodiment.
Figure 9:
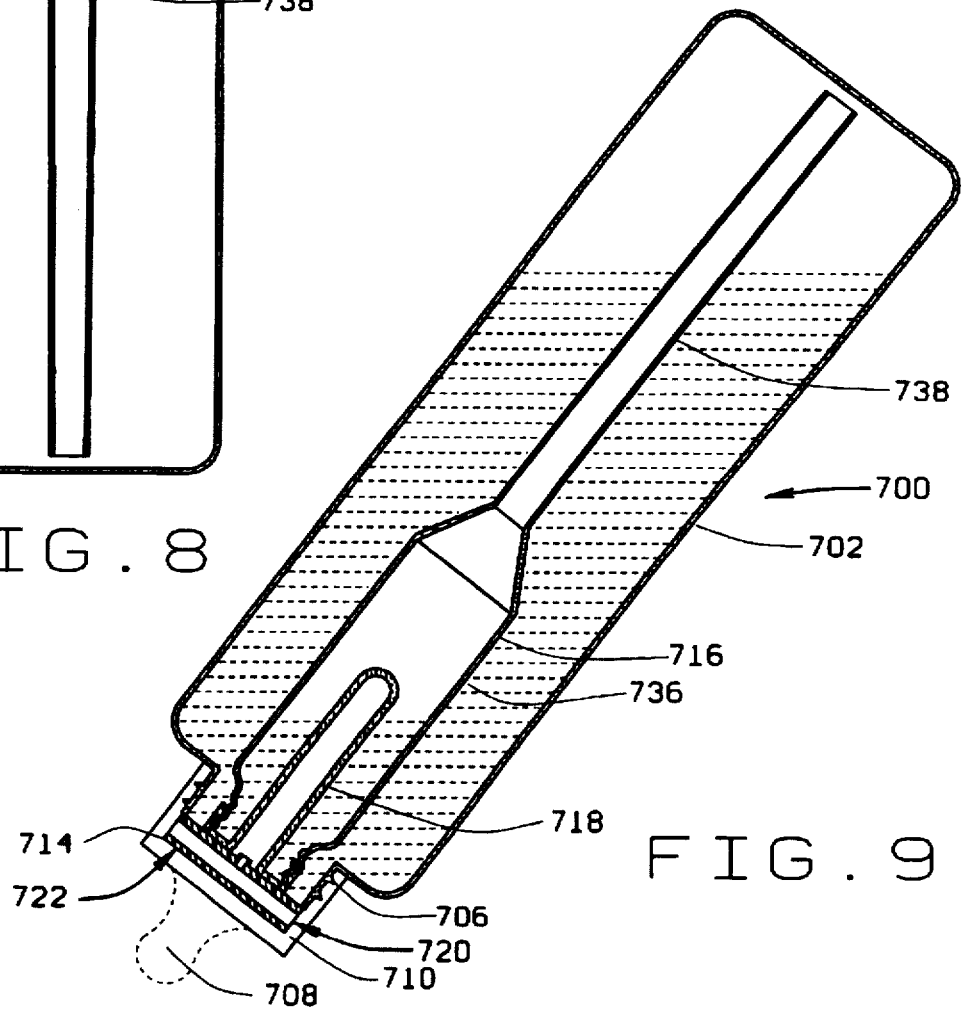
FIG. 9 is a sectional elevational view of the nursing bottle of the second embodiment shown in the inverted, feeding position.
Figure 10:
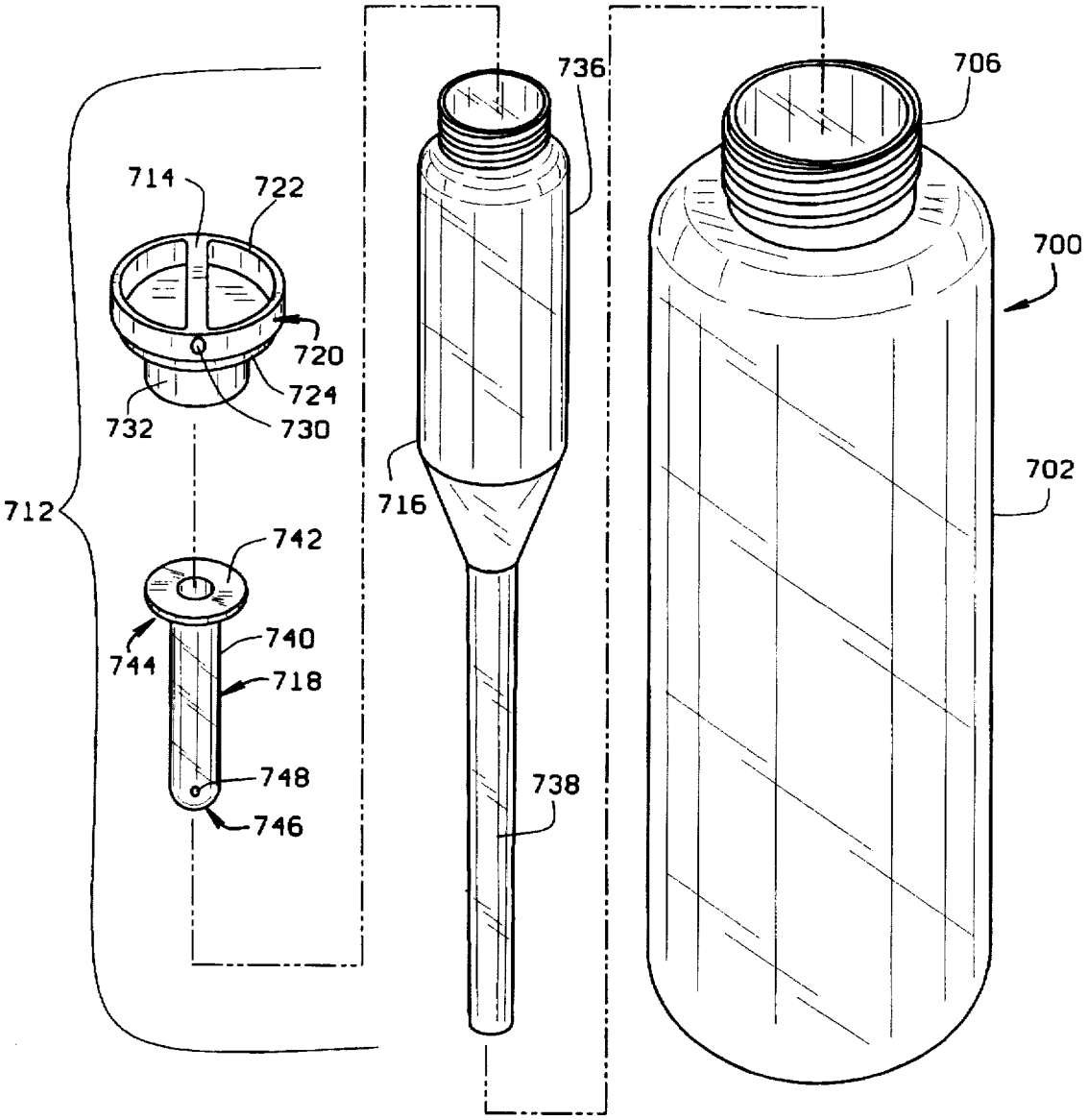
FIG. 10 is a perspective, exploded view of the nursing bottle of the second embodiment.
Figure 11:
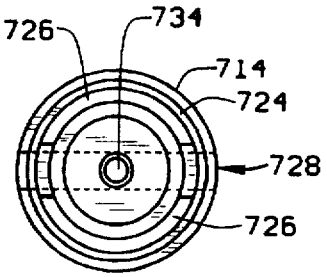
FIG. 11 is a bottom plan view of a vent cap of the nursing bottle of the second embodiment.

A second embodiment of the nursing bottle of this invention, indicated generally as 700, is shown in FIGS. 6–11. The bottle 700 includes a container 702 having an open top 704 surrounded by a threaded neck 706. The bottle 700 also includes a conventional nipple 708, that can be secured with a threaded ring-shaped collar 710. A vent unit 712 is interposed between the top of the neck and the nipple, and extends into the container 702. The vent unit 712 comprises a vent insert 714, a reservoir tube 716 depending from the insert, and a vent tube 718 depending from the insert inside the reservoir tube.

The insert 714 comprises a generally cylindrical sidewall 720 having a flat circular top surface 722 against which the nipple 708 can seal, and a circumferential groove 724 at the bottom of the sidewall adapted to engage and seal with the top of the neck 706 of the container. There are curved slots 726 in the insert 714 to permit liquid to flow through the insert from the interior of the container 702 to the nipple 708.

A hollow conduit 728 extends diametrically across the insert 714, communicating with openings 730 in the exterior of the sidewall 720. There is a tubular extension 732 depending from the underside of the insert 714. The extension 732 is within the curved slots 726, so that it does not interfere with flow of liquid through slots in the insert. The extension 732 is internally threaded. There is an opening 734 generally in the bottom of the insert 714, inside the extension 732, that communicates with the conduit 728.

The reservoir tube 716 has an upper section 736 and a lower section 738. The upper portion of the upper section 736 is externally threaded to engage the interior threads in the extension 732. The reservoir tube 716 extends downwardly into the container 702 sufficiently so that when the bottle 700 filled with liquid is inverted, the open lower end of the reservoir tube is above the level of the liquid in the inverted bottle. The upper section 736 has a larger cross sectional area than the lower section so that the upper section can easily accommodate the volume of fluid that the lower section can hold.

The vent tube 718 comprises a short cylindrical section 740 having an large annular flange 742 at its upper end 744, and a rounded closed lower end 746. The vent tube 718 fits in the extension 732, with the upper end of the reservoir tube 716 holding the flange 742 against the bottom of the insert, and thereby sealing the vent tube against the bottom of the insert 714. There is a small opening 748 in the lower end 746 of the vent tube 718, preferably on the side of the vent tube adjacent the bottom. The vent tube 718 projects sufficiently into the reservoir tube 716 so that when the bottle 700 filled with liquid is inverted, the lower end 746 of the vent tube, and more specifically the opening 748, is above the level of the liquid trapped in the reservoir tube 716. Thus the vent unit 712 provides an airway between the exterior of the bottle and a point in the reservoir tube that is above the level of the liquid trapped in the reservoir tube when the bottle is inverted. However, the vent tube 718 preferably does not project so far that it is below the level of the liquid in the reservoir tube 716 when the bottle 700 is upright.

The vent unit 712 provides air to the interior bottle 700 so that when an infant suck liquid from the bottle, the volume is replaced, preventing the creation of a partial vacuum inside the bottle that would make it increasingly difficult for the infant to suck liquid from the bottle.

In operation the vent unit 712 is assembled by placing the upper end of the vent tube 718 into the extension 732, and then threading the threaded upper portion of the upper section 736 of the reservoir tube 716 into the internal threads on the extension 732. The container 702 is filled with a liquid, such as water, juice, or milk. The vent insert 714 is then placed on the top of the neck 706 of the container, with the groove 724 seating against and sealing with the top of the neck. The nipple 708 is placed over the top of the insert 714 and the collar 710 is threaded onto the threads on the neck 706 to compress the nipple against the circular seat on the insert, and to compress the insert against the top of the neck.

The infant can easily suck the liquid in the bottle through the nipple, the liquid flowing freely through the slots 726 in the insert from the interior of the container. When the bottle is inverted to draw liquid through the nipple, some of the liquid is trapped in the reservoir tube 716. This liquid flows into the upper section 736. Because of the relative sizing of the upper section 736 and the lower section 738, and the length of the vent tube 718, the end of the vent tube is above the level of the liquid trapped in the reservoir tube 716, providing a continuous air path from the exterior of the bottle to the air space above the liquid in the inverted bottle. As the liquid is sucked from the inside of the container, it is replaced with air that passes between the threaded collar 710 and the threads on the neck 706, through the openings 730 into the air conduit 728, and from there through the opening 734 into the vent tube 718 through the opening 748 in the end of the vent tube, and through the reservoir tube 716 to the air space above the liquid in the inverted bottle. This prevents the formation of a vacuum in the bottle.

In operation, the nursing bottle of this invention is assembled to provide a container preventing the formation of a vacuum inside the container when liquid is withdrawn during use. A vacuum is prevented from being formed in the interior of the bottle during use and the baby nursing from the bottle is not forced to suck so hard that air is inadvertently swallowed. As a result, the chances of colic are greatly reduced.

FIGS. 1–5 illustrate a first embodiment of the nursing bottle of this invention. In bottle 600 the vent unit 612 is interposed between the container 602 and the collar 610 and nipple 608 without having extensions protruding outside of the bottle.

A second embodiment of the nursing bottle of this invention is shown in FIGS. 6–11. The bottle includes a container 702 having an open top 704 surrounded by a threaded neck 706. The bottle also comprises a ring-shaped collar 710 adapted to secure a conventional nipple 708 on the container. The bottle also comprises a vent unit 712 interposed between the top of the neck and the nipple, and extends into the container 702. When the container is inverted, the liquid from the lower portion of the vent unit 712 flows into the upper portion and no additional liquid enters the vent unit. Thus, atmospheric air is free to enter into the container by flowing from outside the bottle through the vent unit 712. Thus, a vacuum is prevented from being formed within the interior of the container during use and a baby nursing from a bottle is not forced to inadvertently swallow air so that the chances of colic are reduced.

We claim:

1. A nursing bottle adapted to be filled with liquid, wherein the bottle prevents a vacuum from being formed within the bottle when inverted, the nursing bottle comprising:

a container having an open top and being adapted to contain a quantity of liquid;

a vent unit adapted to fit within the container comprising a reservoir tube having an upper and lower portion, the reservoir tube having a proximal first end adapted to fit adjacent the top of the container and an open second end projecting sufficiently downwardly in the container so that when the bottle is inverted the open second end is above the level of the liquid in the container; and an airway in the vent unit extending between the outside of the container and a point in the reservoir tube above the level of the liquid trapped in the reservoir tube when the nursing bottle is inverted.

2. The nursing bottle according to claim 1 wherein the vent unit includes a vent tube, forming a portion of the airway, having a distal end, the vent tube projecting into the reservoir tube sufficiently so the distal end of the vent tube is above the level of liquid trapped in the reservoir tube when the bottle is inverted.

3. The nursing bottle according to claim 2 wherein the vent tube has an opening at its distal end.

4. The nursing bottle according to claim 1 wherein the vent unit further comprises an insert which secures to the reservoir tube, said insert being adjacent to the reservoir tube preventing liquid from entering the airway and allowing air to flow through the airway.

5. The nursing bottle according to claim 1 wherein the vent unit is detachable from the container.

6. The nursing bottle according to claim 1 wherein the cross-section of the upper portion of the reservoir tube has a larger diameter than the cross-section of the lower portion of the reservoir tube.

7. A container which vents an interior thereof to the atmosphere to resist the formation of a vacuum when the container is inverted to dispense a liquid therefrom, the container comprising: a receptacle adapted to hold liquid, a liquid outlet for dispensing the liquid when the container is inverted, a vent unit adapted to fit within the receptacle, said vent unit comprising a reservoir tube having upper and lower portions, the reservoir tube having a proximal first end adjacent the top of the receptacle and an open second end projecting sufficiently downwardly into the receptacle so that when the container is inverted, the open second end is above the level of the liquid in the receptacle, an airway in the vent unit extending between the outside of the receptacle and a point in the reservoir tube above the level of liquid trapped in the reservoir tube when the container is inverted, and a vent unit forming a portion of said airway adapted to fit within the reservoir tube, having a distal end, the vent tube projecting into the reservoir tube sufficiently so the distal end of the vent tube is above the level of liquid trapped in the reservoir tube when the bottle is inverted.

8. An improved baby bottle of the type having a nipple, the improvement comprising:

a reservoir tube having a proximal first end and an open second end, the second end of the reservoir tube projecting sufficiently downwardly in the bottle so that when the bottle is inverted the second end of the reservoir tube is above the level of the liquid trapped in the inverted bottle; and an air passage between the outside of the bottle and a point in the reservoir tube above the level of the liquid trapped inside the reservoir tube when the bottle is inverted, the air passage and reservoir tube allowing atmospheric air to flow into the bottle to prevent the formation of a vacuum within the bottle when liquid is withdrawn.

9. A vent unit adapted to install in the open top of a container to vent the container to the atmosphere to resist the formation of a vacuum when the container is inverted to dispense liquid, the vent unit comprising: a reservoir tube having a proximal first end and an open second end, wherein the first end is adjacent the open top of the container, the second end of the reservoir tube projecting sufficiently downwardly in the container so that when the container is inverted the second end is above the liquid in the inverted container, the vent unit having an airway extending from the exterior of the container to a point in the reservoir tube above the level of the liquid trapped inside the reservoir tube when the container is inverted, and a vent tube forming a portion of said airway said vent tube adapted to fit within the reservoir tube, having a distal end, the vent tube projecting into the reservoir tube sufficiently so the distal end of the vent tube is above the level of the liquid trapped in the reservoir tube when the container is inverted.

* * * * *

US005779071C1

(12) EX PARTE REEXAMINATION CERTIFICATE (6352nd)

United States Patent
Brown et al.

(10) Number: US 5,779,071 C1
(45) Certificate Issued: Aug. 12, 2008

(54) NURSING BOTTLE WITH AN AIR VENTING STRUCTURE

(75) Inventors: Craig E. Brown, Mt. Zion, IL (US); Robert J. Brown, Bonne Terre, MO (US); Bernard J. Kemper, Bonne Terre, MO (US); David E. Hays, Desloge, MO (US)

(73) Assignee: New Vent Designs, Inc., Mt. Zion, IL (US)

Reexamination Request:
No. 90/007,711, Sep. 8, 2005

Reexamination Certificate for:

| | |
|---|---|
| Patent No.: | **5,779,071** |
| Issued: | **Jul. 14, 1998** |
| Appl. No.: | **08/589,117** |
| Filed: | **Jan. 19, 1996** |

Related U.S. Application Data

(63) Continuation-in-part of application No. 08/511,590, filed on Aug. 4, 1995, now Pat. No. 5,570,796.

(51) Int. Cl.
*A61J 9/04* (2006.01)
*A61J 11/02* (2006.01)

(52) U.S. Cl. ..... 215/11.5; 215/11.1; 215/902; 220/DIG. 27

(58) Field of Classification Search ..... None
See application file for complete search history.

(56) References Cited

U.S. PATENT DOCUMENTS

| | | | |
|---|---|---|---|
| 979,607 | A | 12/1910 | Van Cleave |
| 3,254,809 | A | 6/1966 | Breneman |
| 5,054,660 | A | 10/1991 | Sherman et al. |
| 5,269,444 | A | 12/1993 | Wright |
| 5,284,262 | A | 2/1994 | O'Nan |
| 5,449,098 | A | 9/1995 | Offman |
| 5,678,710 | A | 10/1997 | Sheu |

FOREIGN PATENT DOCUMENTS

| | | |
|---|---|---|
| DE | 19601198 | 7/1997 |
| GB | HC 5C00847 | 2/2005 |
| SE | 8200147 | 1/1982 |

*Primary Examiner*—Beverly M. Flanagan

(57) ABSTRACT

A container having an open top and being adapted to be filled with liquid, wherein a vacuum is prevented from being formed within the container when inverted comprising a receptacle adapted to contain a quantity of liquid, a vent unit adapted to fit within the receptacle comprising a reservoir tube having an upper and lower portion, the reservoir tube having a proximal first end adjacent the top of the container and an open second end projecting sufficiently downwardly in the container, wherein the vent unit has an airway between the outside of the container and a point in the reservoir tube, a reservoir tube having a distal end having an opening, the vent tube projecting downwardly into the upper portion of the vent tube, and an airway extending from outside the container through the vent tube into the vent unit so that when the container is filled with liquid and inverted, the open end of the reservoir tube is above the liquid level in the container and the opening in the vent tube is above the liquid level in the upper portion of the vent unit forming a continuous air path from outside of the container through the extension and through the lower portion of the reservoir tube.

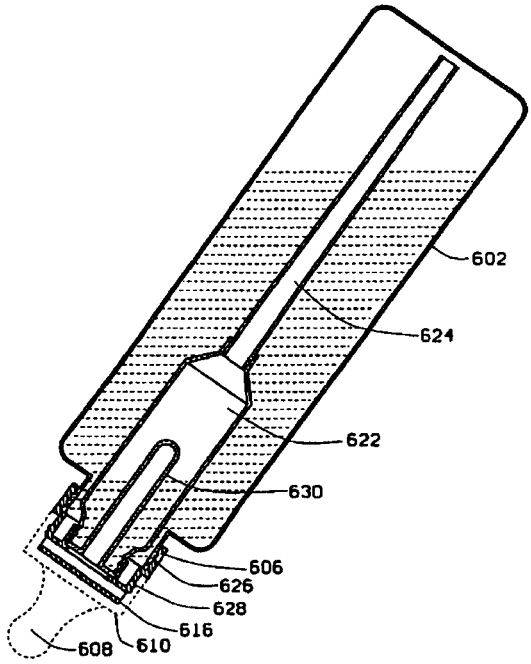

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 7–9 are determined to be patentable as amended.

Claims 3–6, dependent on an amended claim, are determined to be patentable.

New claims 10 and 11 are added and determined to be patentable.

1. A nursing bottle adapted to be filled with liquid, wherein the bottle prevents a vacuum from being formed within the bottle when inverted, the nursing bottle comprising:

a container having an open top and being adapted to contain a quantity of liquid;

a vent unit adapted to fit within the container comprising a reservoir tube having an upper and lower portion. the reservoir tube having a proximal first end adapted to fit adjacent the top of the container and an open second end projecting sufficiently downwardly in the container so that when the bottle is inverted the open second end is above the level of the liquid in the container: [and]

*said vent unit incorporating a vent tube extending downwardly into said reservoir tube sufficiently to provide for supplemental venting of the container to substantially prevent the discharge of any liquid from the vent tube when the nursing bottle is inverted; and* an airway in the vent unit extending [between] *from* the outside of the container [and] *through the vent tube to* a point in the reservoir tube above the level of the liquid trapped in the reservoir tube when the nursing bottle is inverted.

2. [The nursing bottle according to claim 1] *A nursing bottle adapted to be filled with liquid, wherein the bottle prevents a vacuum from being formed within the bottle when inverted, the nursing bottle comprising:*

*a container having an open top and being adapted to contain a quantity of liquid;*

*a vent unit adapted to fit within the container comprising a reservoir tube having an upper and lower portion, the reservoir tube having a proximal first end adapted to fit adjacent the top of the container and an open second end projecting sufficiently downwardly in the container so that when the bottle is inverted the open second end is above the level of the liquid in the container;*

*an airway in the vent unit extending between the outside of the container and a point in the reservoir tube above the level of the liquid trapped in the reservoir tube when the nursing bottle is inverted; and* wherein the vent unit includes a vent tube, forming a portion of the airway, having a distal end, the tube projecting *downwardly* into the reservoir tube sufficiently so the distal end of the vent tube is above the level of liquid trapped in the reservoir tube when the bottle is inverted.

7. A container which vents an interior thereof to the atmosphere to resist the formation of a vacuum when the container is inverted to dispense a liquid therefrom, the container comprising: a receptacle adapted to hold liquid, a liquid outlet for dispensing the liquid when the container is inverted, a vent unit adapted to fit within the receptacle, said vent unit comprising a reservoir tube having upper and lower portions, the reservoir tube having a proximal first end adjacent the top of the receptacle and an open second end projecting sufficiently downwardly into the receptacle so that when the container is inverted, the open second end is above the level of the liquid in the receptacle, an airway in the vent unit extending between the outside of the receptacle and a point in the reservoir tube above the level of liquid trapped in the reservoir tube when the container is inverted, and [a] *said* vent unit forming a portion of said airway adapted to fit within the reservoir tube, having a distal end, [the] *a* vent tube *of the vent unit* projecting *downwardly* into the reservoir tube sufficiently so the distal end of the vent tube *and its airway* is above the level of liquid trapped in the reservoir tube when the bottle is inverted.

8. An improved baby bottle of the type having a nipple, the improvement comprising:

*double venting provided within the baby bottle and including a first vent incorporating a reservoir tube, and a second vent contained within the said first vent;*

[a] *said* reservoir tube having a proximal first end and an open second end, the second end of the reservoir tube projecting sufficiently downwardly in the bottle so that when the bottle is inverted the second end of the reservoir tube is above the level of the liquid trapped in the inverted bottle; and an air passage between the outside of the bottle and a point in the reservoir tube above the level of the liquid trapped inside the reservoir tube when the bottle is inverted, *wherein said vent unit includes said vent tube forming a portion of the air passage, said vent tube projecting downwardly into the reservoir tube sufficiently so that the distal end of the vent tube is also above the level of liquid trapped in the reservoir tube when the bottle is inverted,* the air passage and reservoir tube allowing atmospheric air to flow into the bottle to prevent the formation of a vacuum within the bottle when liquid is withdrawn.

9. A vent unit adapted to install in the open top of a container to vent the container to the atmosphere to resist the formation of a vacuum when the container is inverted to dispense liquid, the vent unit comprising: a reservoir tube having a proximal first end and an open second end, wherein the first end is adjacent the open top of the container, the second end of the reservoir tube projecting sufficiently downwardly in the container so that when the container is inverted the second end is above the liquid in the inverted container, the vent unit having an airway extending from the exterior of the container to a point in the reservoir tube above the level of the liquid trapped inside the reservoir tube when the container is inverted, and a vent tube forming a portion of said airway, said vent tube adapted to fit within the reservoir tube, having a distal end, the vent tube projecting *downwardly* into the reservoir tube sufficiently so the distal end of the vent tube is above the level of the liquid trapped in the reservoir tube when the container is inverted.

*10. A nursing bottle adapted to be filled with liquid, wherein the bottle prevents a vacuum from being formed within the bottle when inverted, the nursing bottle comprising:*

*a container having an open top and being adapted to contain a quantity of liquid;*

*a nipple held onto the proximate open top of the container;*

*a vent unit adapted to fit within the container comprising a reservoir tube having an upper and lower portion, the reservoir tube having a proximal first end adapted to fit adjacent the top of the container and an open second end projecting sufficiently downwardly in the container so that when the bottle is inverted the open second end is above the level of liquid in the container, said reservoir tube having a side wall defining an interior passage of said reservoir tube extending from the proximal first end to the open second end of said reservoir tube;*

*an airway in the vent unit extending between the outside of the container and a point in the interior passage of the reservoir tube above the level of liquid trapped in the reservoir tube when the nursing bottle is inverted, and said airway extending other that through the side wall of the reservoir tube; and*

*wherein the vent unit includes a vent tube, forming a portion of the air way, having a distal end, the vent tube projecting downwardly into the reservoir tube sufficiently so the distal end of the vent tube is above the level of liquid trapped in the reservoir tube when the bottle is inverted.*

*11. A nursing bottle as set forth in claim 10 wherein said vent unit further comprises said vent insert upon the top of the container, said insert supporting the vent tube depending from the under side thereof and extending downwardly into the reservoir tube.*

* * * * *